US010711525B2

(12) United States Patent
Thornton

(10) Patent No.: US 10,711,525 B2
(45) Date of Patent: Jul. 14, 2020

(54) HEAVY EQUIPMENT CONCRETE CORE DRILL BIT STABILIZER

(71) Applicant: Lee C. Thornton, Huntsville, AL (US)

(72) Inventor: Lee C. Thornton, Huntsville, AL (US)

( * ) Notice: Subject to any disclaimer, the term of this patent is extended or adjusted under 35 U.S.C. 154(b) by 16 days.

(21) Appl. No.: 16/363,412

(22) Filed: Mar. 25, 2019

(65) Prior Publication Data

US 2019/0360273 A1 Nov. 28, 2019

Related U.S. Application Data

(63) Continuation-in-part of application No. 15/990,756, filed on May 28, 2018, now Pat. No. 10,279,508.

(51) Int. Cl.

| | |
|---|---|
| ***E21B 10/02*** | (2006.01) |
| ***E21B 10/62*** | (2006.01) |
| ***B28D 1/04*** | (2006.01) |

(52) U.S. Cl.

CPC ..... *E21B 10/02* (2013.01); *B28D 1/04* (2013.01); *E21B 10/62* (2013.01)

(58) Field of Classification Search

CPC ..... B28D 1/041; B28D 1/045; B28D 1/14; B28D 1/044; E01C 23/094; E01C 23/0933; B23B 2226/75; E21B 7/027; E21B 7/028; E21B 7/24; E21B 10/02; E21B 10/48

USPC ..... 408/74, 79, 97, 204, 193, 115

See application file for complete search history.

(56) References Cited

U.S. PATENT DOCUMENTS

| | | | | | |
|---|---|---|---|---|---|
| 2,680,457 | A * | 6/1954 | Kakuk | B23D 47/042 | 144/103 |
| 3,331,585 | A * | 7/1967 | Dubberke | E21B 19/00 | 166/77.53 |
| 3,366,185 | A * | 1/1968 | Heise | E01C 23/094 | 173/186 |
| 3,848,687 | A | 11/1974 | Funakubo | | |
| 4,116,287 | A * | 9/1978 | Foster | E21B 19/10 | 173/164 |
| 4,505,614 | A * | 3/1985 | Anschutz | E21B 17/1007 | 175/220 |
| 4,567,952 | A * | 2/1986 | Lemaire | E21B 19/16 | 173/164 |
| 4,763,735 | A | 8/1988 | Gay | | |
| 5,007,776 | A * | 4/1991 | Shoji | B23Q 11/04 | 408/11 |
| 5,058,688 | A * | 10/1991 | Scott | E21B 7/24 | 175/122 |
| 5,388,652 | A * | 2/1995 | Smith | E21B 19/163 | 166/77.53 |

(Continued)

*Primary Examiner* — Carib A Oquendo
(74) *Attorney, Agent, or Firm* — Cynthia R. Wright

(57) ABSTRACT

The present invention is an accessory device that hole coring machine, wherein the hole coring machine is utilized to quickly and efficiently core holes in concrete and asphalt. The accessory device comprises a stabilizer assembly that is coupled to a base of the hole coring machine. The stabilizer assembly includes at least one stabilizing frame that is formed to the outside diameter of a drill saw bit of the hole coring machine. The at least one stabilizing frame is coupled to an air compressor that causes the stabilizing frame to move relative to the drill saw bit during operation of the hole coring machine. The at least one stabilizing frame aids in maintaining the shape of the drill saw bit and reduces vibration and binding of the drill saw bit while forming a hole in concrete and/or asphalt.

8 Claims, 10 Drawing Sheets

(56) References Cited

U.S. PATENT DOCUMENTS

| | | | | |
|---|---|---|---|---|
| 5,470,131 | A * | 11/1995 | Nolan | E01C 23/094 299/41.1 |
| 5,687,205 | A | 11/1997 | Matsumoto et al. | |
| 6,907,874 | B1 | 6/2005 | Faircloth | |
| 2008/0017182 | A1 | 1/2008 | Hilsgen | |
| 2016/0258216 | A1* | 9/2016 | Baaske | E21B 7/024 |
| 2017/0198524 | A1 | 7/2017 | Patterson | |
| 2017/0321489 | A1* | 11/2017 | Jurjevic | E21B 7/028 |

* cited by examiner

HEAVY EQUIPMENT CONCRETE CORE DRILL BIT STABILIZER

CROSS-REFERENCE TO RELATED APPLICATIONS

This application is a continuation-in-part of U.S. Non-Provisional application Ser. No. 15/990,756, and this application claims the benefit of U.S. Non-Provisional application Ser. No. 15/990,756, filed on May 28, 2018, which names Lee C. Thornton as the inventor.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM

Not applicable.

STATEMENT REGARDING PRIOR DISCLOSURES BY THE INVENTOR OR JOINT INVENTOR

The inventor did not disclose the invention herein prior to the 12 month period preceding the filing of this non-provisional continuation-in-part application.

BACKGROUND OF THE INVENTION

(1) Field of the Invention

Commercial and industrial sites often require a concrete or asphalt slab to be cored with a hole. Holes up to thirty-six inches in diameter or larger and depths of up to 16 inches or greater may be needed. For example, holes may be cored for the installation, maintenance and repair of floor drains, sewer drains/sewer tie-ins, HVAC openings, the installation, maintenance and repair of phone, electrical, cable, and fiber optic lines, the installation of handrails, the installation of lights and light poles, the installation of concrete safety barriers, the detection and repair of underground utilities and the installation of anchor holes. Concrete drum saws are utilized to core holes in concrete and asphalt for these and many more applications. Concrete drum saws can be expensive to acquire and maintain. Additionally, concrete drum saws are often difficult to operate and may require two or more operators at a time, leading to increased costs in man hours. The devices currently available for coring holes in concrete or asphalt are highly susceptible to binding and/or bunching, which interferes with drum saw performance and can slow the coring process and may damage the drum saw. Drum saws frequently go out of "round" (lose their circular shape) resulting in the coring of holes that are out of "round". Drum saws out of round core a wide cut in asphalt, while round drum saws core a narrow cut in asphalt. Wide core cuts require more time to produce and generate more wear-and-tear on the drum saw. There is a need for a drum saw that will cut round, narrow cores in asphalt and cement.

This invention relates generally to an accessory that may be attached to a concrete hole coring machine to stabilize the drill bit while the machine is coring a hole. The device disclosed herein reversibly attaches to a hole coring apparatus and utilizes an air compressor, or other hydraulic or mechanical means, to manipulate stabilizers that are positioned around the outer perimeter of said drill bit. This stabilizing device reduces binding of the drum saw during operation of a hole coring machine, and allows for smoother, quicker hole coring by reducing out-of-round drill bits. This drill bit stabilizer device extends the operational life of the drum saw and the hole coring machine.

(2) Description of Related Art

A number of hole coring saws are known in the art. Faircloth (U.S. Pat. No. 6,907,874 B1) discloses a machine that cuts holes in concrete slabs comprising a connector adapted to be secured in an adapter of a front-end loader. The device of Faircloth includes a first frame structure secured to the connector wherein the first frame structure includes an elongated tube and a support foot for engaging the surface of a concrete slab and supporting the first frame structure. The elongated tube includes a telescoping beam that slides back and forth allowing linear movement of an attached concrete hole cutting saw unit that includes a drum type concrete saw. Interconnected between the beam and the first frame structure is an actuator that moves the elongated beam and saw cutting unit back and forth between a retracted and extended position. The drum saw is moved laterally in respect to the front loader. The device of Faircloth has a number of deficiencies. Faircloth includes a single square mast that serves as both the carriage guide and the drive system. A group of rollers or bushings are utilized in an attempt to stabilize the carriage and a single or series of gears rides up and down a row of teeth attached to one side of the mast. The user of this device experiences significant binding of the bit. The drill bit stabilizer device disclosed herein reduces the binding of the bit by stabilizing the drill bit during operation.

This device enables the core bit to travel in a parallel line reducing or eliminating any out-of-round cores, and reducing or eliminating pinching between the side walls of the substrate being cored (concrete, asphalt, etc.). When friction becomes too great, the bit binds and can become stuck in the substrate causing increased wear on the machine, increased wear on the bit, increased time coring holes, and a potential safety hazard. This drill bit stabilizer device reduces or eliminates friction, reducing wear on the machine.

BRIEF DESCRIPTION OF THE SEVERAL VIEWS OF THE DRAWINGS

FIG. 5 is a top view of the Heavy Equipment Concrete Core Drill Bit Stabilizer, while

DETAILED DESCRIPTION OF THE INVENTION

Figure 1:
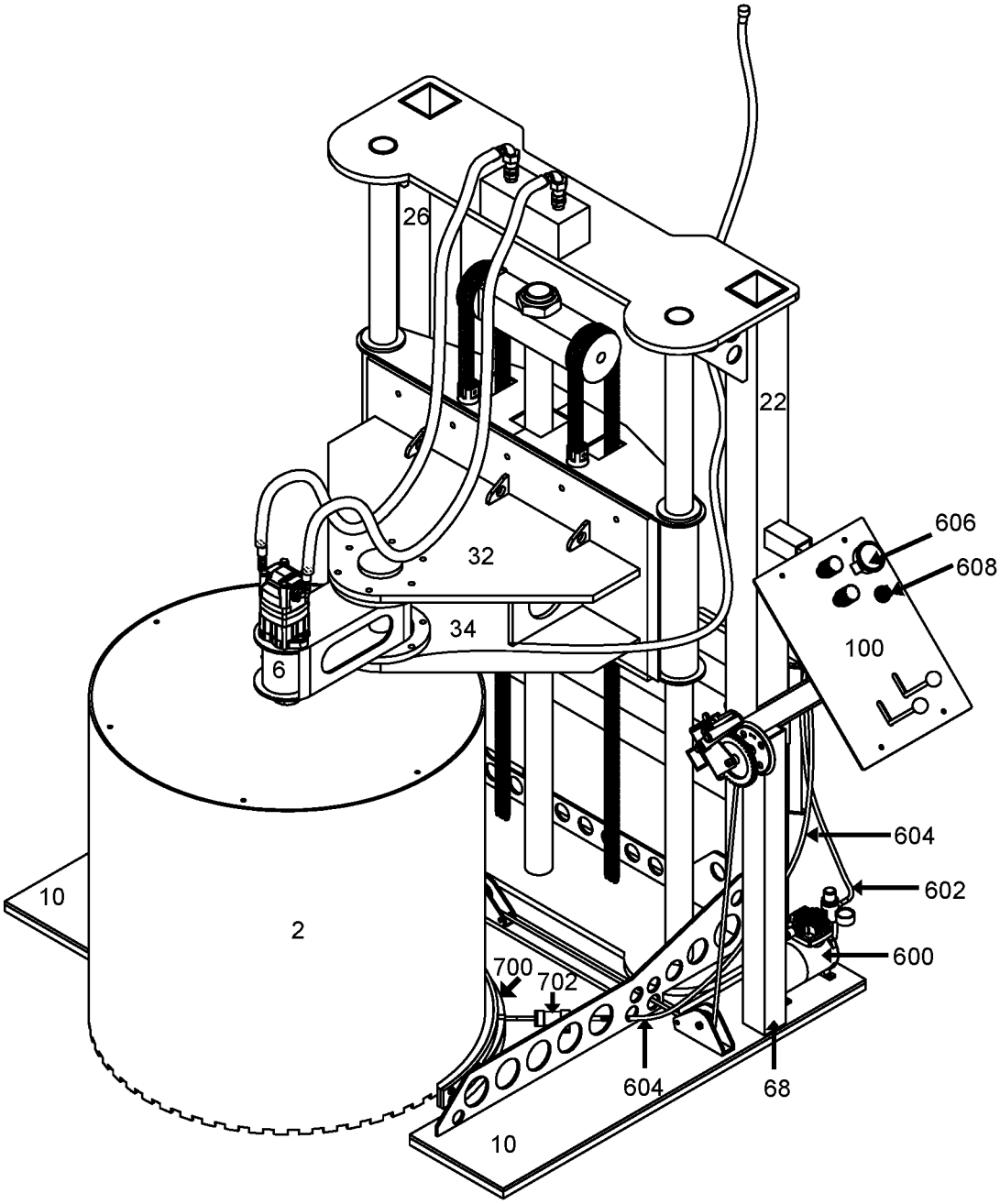
FIG. 1 depicts a front, angled view of a two-post hole coring machine with the drill bit stabilizer device attached thereto.

This application is a continuation-in-part of U.S. Non-Provisional application Ser. No. 15/990,756. U.S. Non-Provisional application Ser. No. 15/990,756 is incorporated herein by reference as if fully set forth herein.

While this invention is susceptible of embodiment in many different forms, there are shown in the drawings and will herein be described in detail, several embodiments with the understanding that the present disclosure should be considered as an exemplification of the principles of the invention and is not intended to limit the invention to the embodiments so illustrated. Further, to the extent that any numerical values or other specifics of materials, etc., are provided herein, they are to be construed as exemplifications of the inventions herein, and the inventions are not to be considered as limited thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one, or an, embodiment in the present disclosure can be, but not necessarily are, references to the same embodiment; and, such references mean at least one of the embodiments.

Reference in this specification to "one embodiment' or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments, but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, or is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

This disclosure includes an drill bit stabilizer device that may be mounted onto a hole coring machine. The drill bit stabilizer device is depicted installed onto three embodiments: two-post, three-post, and four-post embodiments. This drill bit stabilizer device may be installed onto any hole coring machine whether said hole coring machine is depicted in the figures herein.

The device herein comprises a drill bit stabilizer device that may be installed onto the frame of a hole coring machine. The drill bit stabilizer device reduces or eliminates problems encountered by a user when operating a hole coring machine.

FIG. 1 depicts a front, angled view of the Heavy Equipment Concrete Core Drill Bit Stabilizer. This figure depicts the drill bit stabilizer on a two-post embodiment of the Heavy Equipment Concrete Core Drill Attachment device, which was disclosed in U.S. Non-Provisional application Ser. No. 15/990,756. The drill bit stabilizer can be utilized on any device that is used to drill or core a hole into or through concrete or asphalt. Frame posts 22 and 26 connect to base 10 forming the two-post embodiment. Air compressor 600 is secured unto base 10 so that it does not move or vibrate while the Heavy Equipment Concrete Core Drill Bit Stabilizer device is in use. Air compressor 600 supplies air to 3-way pressure switch 608, which is located on control panel 100, via hose 602. Control panel 100 is shown coupled to base 10 via arm 68. Air pressure gauge 606 controls the movement of air through hose 604. Hose 604 moves air from air pressure gauge 606, which is located on control panel 100, to one or more air pistons 702. One or more air pistons 702 are secured onto base 10. Air piston 702 is coupled to and controls drill bit stabilizer 700. At least one drill bit stabilizer 700 is coupled to base 10. Carriage top plate 32 and carriage bottom plate 34 move drill bit 2 while the Heavy Equipment Concrete Core Drill Bit Attachment is forming a hole in concrete or asphalt. Drill bit 2 moves within drill bit stabilizer 700 as it forms a hole in concrete or asphalt.

Air compressor 600 may be any commercially-available air compressor that provides a stream of air sufficient to control the movement of each drill bit stabilizer 700 utilized.

Drill bit stabilizer 700 may be formed of steel, aluminum or any other material of sufficient strength to form a guide for drill bit 2. When a user starts to core a hole, drill bit 2 may vibrate and bind upon contacting the concrete or asphalt. This vibration and binding is reduced when drill bit 2 vibrates against drill bit stabilizer 700. The reduction in vibration ensures the likelihood that the hole cored will be round, and helps maintain the round shape of drill bit 2. The maintenance of the round shape of drill bit 2 helps to extend the life of drill bit 2.

Drill bit stabilizer 700 helps guide drill bit 2 as it cores a hole in concrete and asphalt. When coring a hole, drill bit 2 may move out of round, causing a wide width core to be produced. For example, an out-of-round cut may have a width of 1 inch along the circumference of the hole cored. When drill bit 2 moves out of round, it makes contact with drill bit stabilizer 700. Drill bit stabilizer 700 forces drill bit 2 back into a round circular motion, creating a narrow clean cut. This narrow, clean cut may be just 0.25 inches wide along the circumference of the hole cored. Drill bit stabilizer 700 reduces the length of time the hole coring device must be operated to core a single core saving man hours and operation costs.

Figure 2:
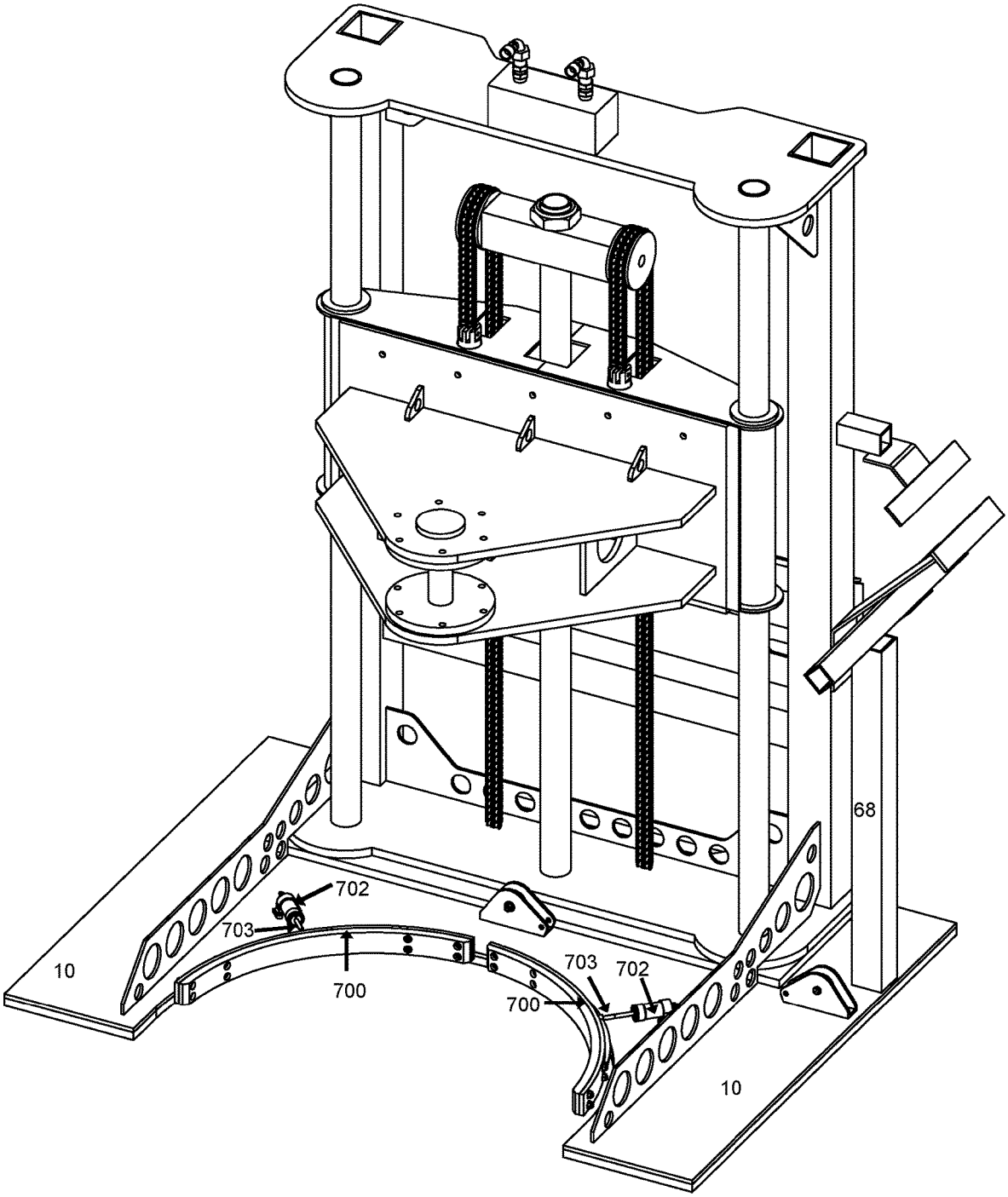
FIG. 2 depicts the device of FIG. 1 with the drum saw bit, motor, and air compressor removed.

FIG. 2 depicts a front, angled view of the bit stabilizer device herein installed on a two-post embodiment of the Heavy Equipment Concrete Core Drill Attachment device with drill bit 2, and the motor and hoses, removed. The device herein may be attached to any core drill that is utilized on concrete, asphalt, or other hard surface. Base 10 forms a support for the core drill attachment. Two drill bit stabilizers 700 are attached to base 10. Each drill bit stabilizer 700 is coupled to an air piston 702 via air piston guide 703.

Figure 3:
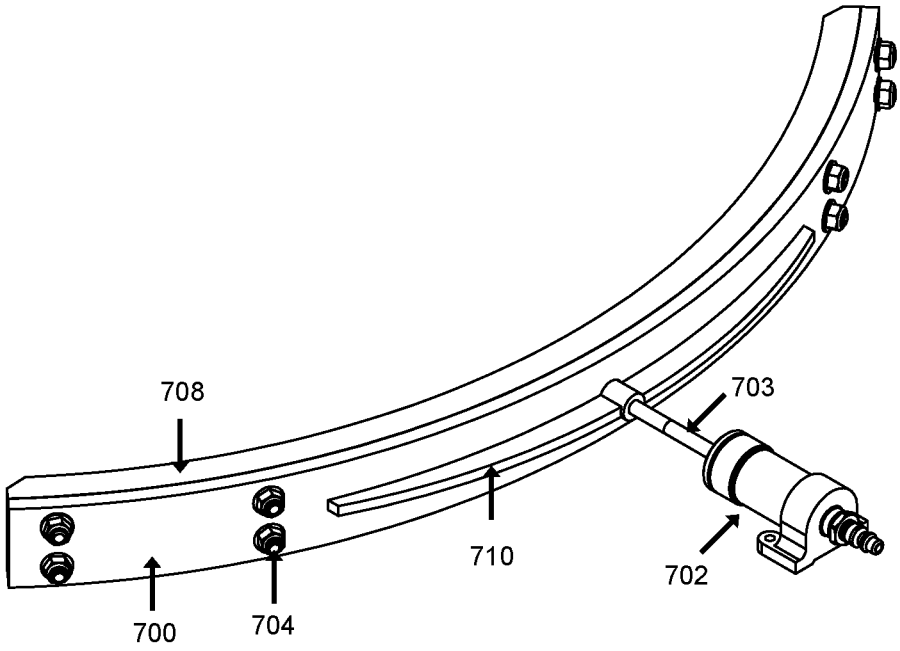
FIG. 3 depicts an angled, side view of the Heavy Equipment Concrete Core Drill Bit Stabilizer.

A single drill bit stabilizer assembly is shown in FIG. 3. A drill bit stabilizer assembly comprises a drill bit stabilizer 700, coupled to an air piston 702 via air piston guide 703, lining 208, and nuts 704 and bolts 706 (shown in FIG. 4). Drill bit stabilizer 700 may be lined with lining 708. Lining 708 may be any low friction polymer to reduce friction that forms when drill bit 2 makes contact with drill bit stabilizer 700. When drill bit stabilizer 700 is engaged to stabilize drill bit 2 (shown in FIG. 1), drill bit stabilizer 700 moves towards drill bit 2 so that lining 708 makes contact with drill bit 2. The contact between lining 708 and drill bit 2 creates friction. This friction forces drill bit 2 into a "round" position, which stabilizes drill bit 2. Air piston 702 may be any commercially-available air piston capable to controlling the movement of drill bit stabilizer 700. Air piston guide 703 is secured unto drill bit stabilizer 700 via stabilizer support arm 710. Air piston 702 may be a pneumatic piston. The movement of air piston guide 703 causes drill bit stabilizer 700 to move either towards air piston 702 (when moving drill bit stabilizer 700 away from drill bit 2) (not shown), or away from air piston 702 (when pushing drill bit stabilizer 700 towards drill bit 2) (not shown).

Figure 4:
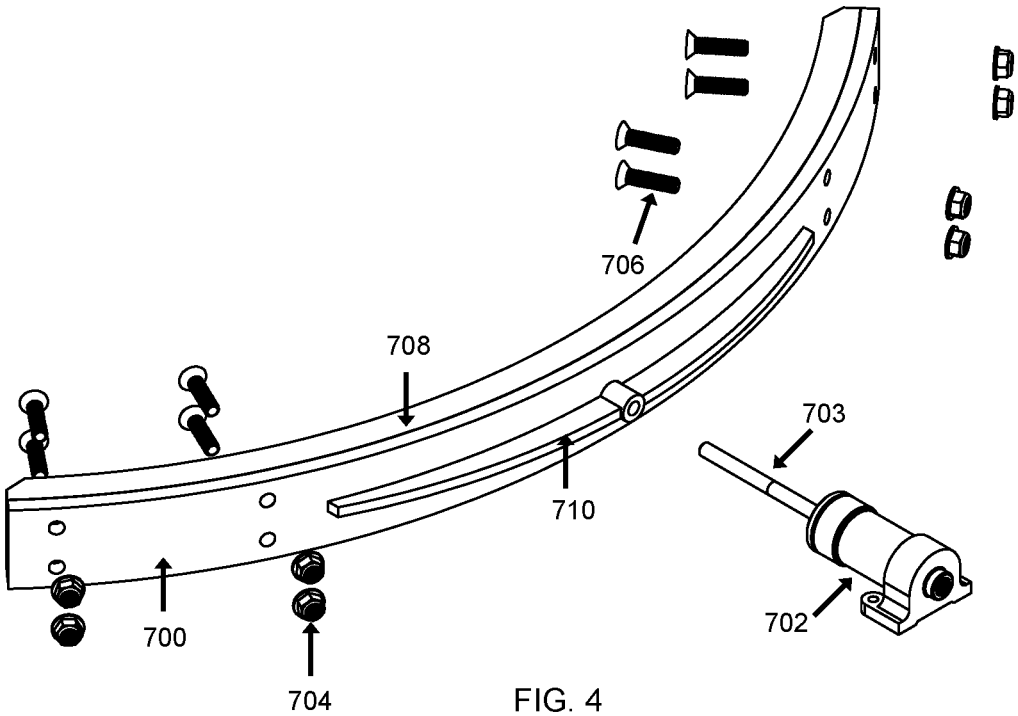
FIG. 4 depicts the device of FIG. 3 with the screws, nuts, pneumatic piston and arm detached and exploded.

Nuts 704 and bolts 706 secure lining 708 onto drill bit stabilizer 700. FIG. 4 illustrates the drill bit stabilizer with nuts 704, bolts 706, air piston 702, and air piston guide 703 exploded away from drill bit stabilizer 700, which has stabilizer support arm 710 attached. Lining 708 may be secured onto the bill bit stabilizer assembly with nuts 704 and bolts 706 or via screws or any other suitable means. Lining 708 may be composed of a low-friction polymer pad formed to line drill bit stabilizer 700. Lining 708 may make direct contact with drill bit 2 (shown in FIG. 1) stabilizing said drill bit 2.

Figure 5:
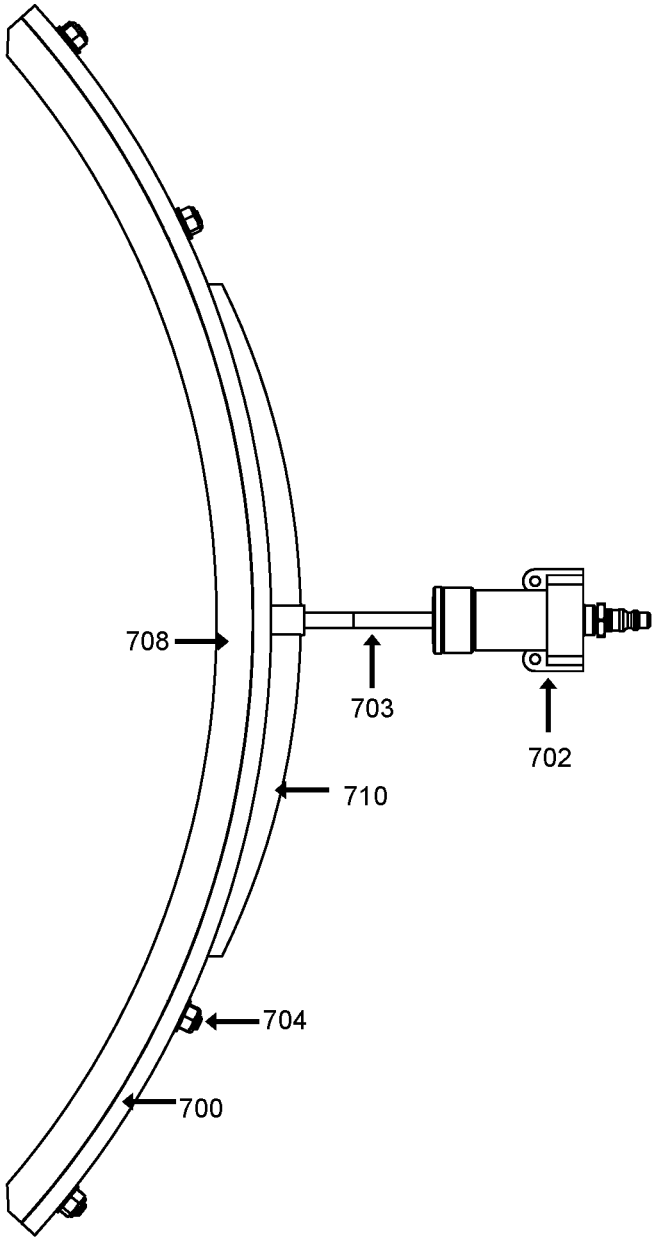
Figure 6:
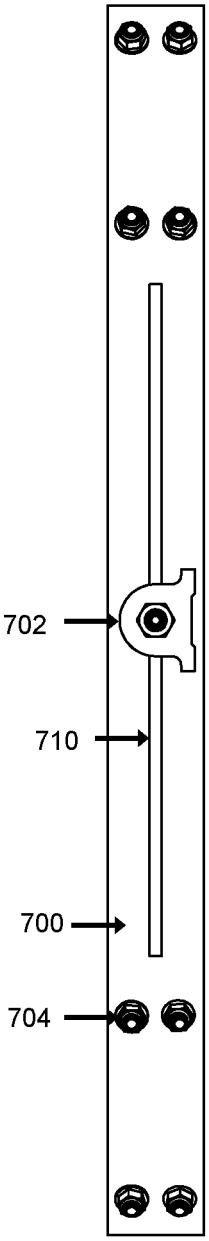
FIG. 6 is a side view.

FIG. 5 illustrates a top view of the drill bit stabilizer assembly, and FIG. 6 shows a top view. Lining 708 is shown secured to drill bit stabilizer 700 via nuts 704 in FIG. 5. Air piston 702 causes air piston guide 703 to retract and extend. FIG. 6 shows air piston 702 positioned relative to stabilizer support arm 710. Four sets of nuts 704 are shown to drill bit stabilizer 700.

Figure 7:
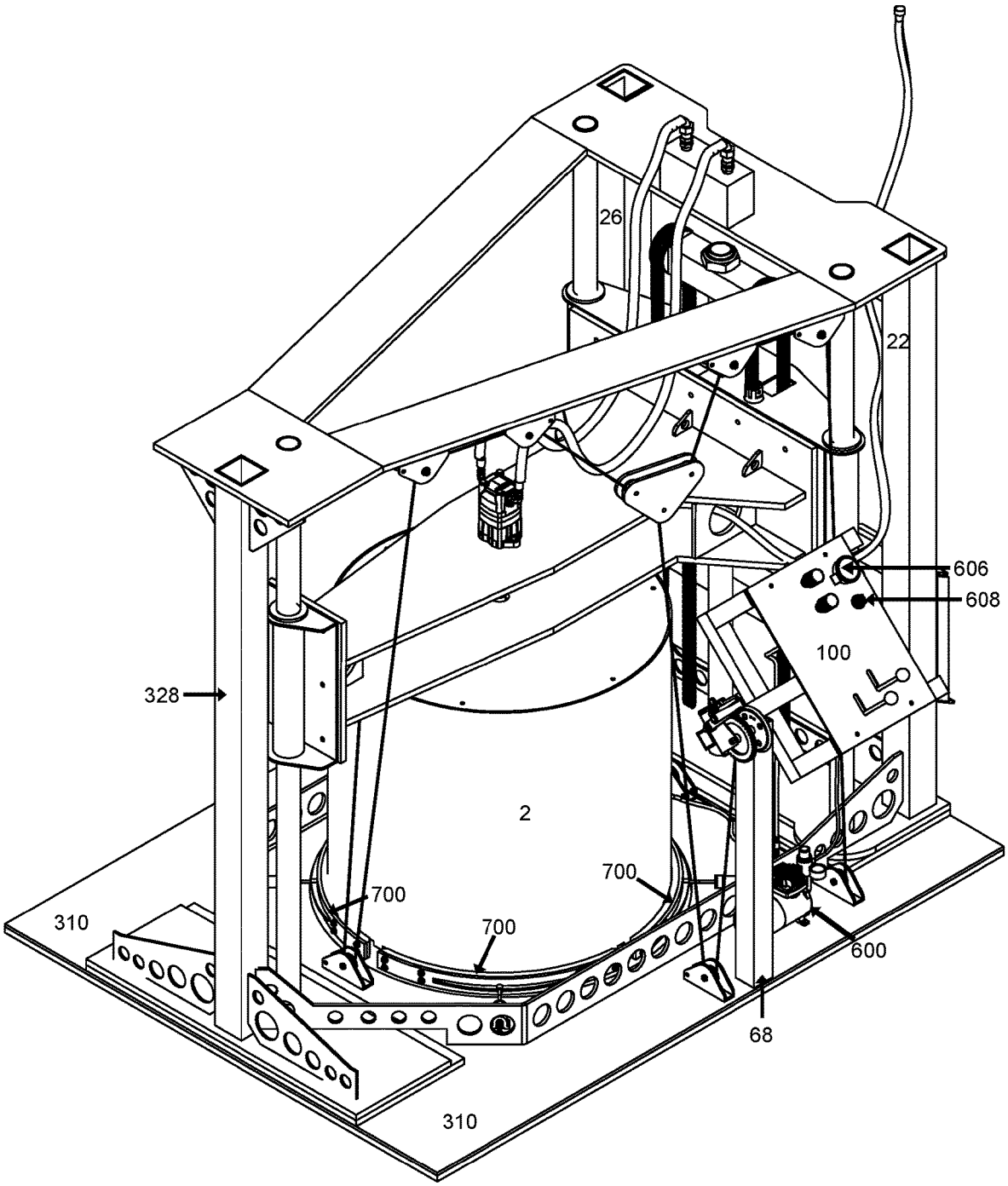
FIG. 7 is a front, angled view of a three-post hole coring machine with the Heavy Equipment Concrete Core Drill Bit Stabilizer attached thereto.

FIG. 7 depicts a front, angled view of a three-post concrete core drill. Three frame posts 22, 26, and 328 connect to base 310. Drill bit 2 is depicted nested inside three drill bit stabilizers 700. Air compressor 600 is attached to base 310. Arm 68 couples control panel 100 to base 310. Air pressure gauge 606 and 3-way pressure switch 608 are shown on control panel 100.

Figure 8:
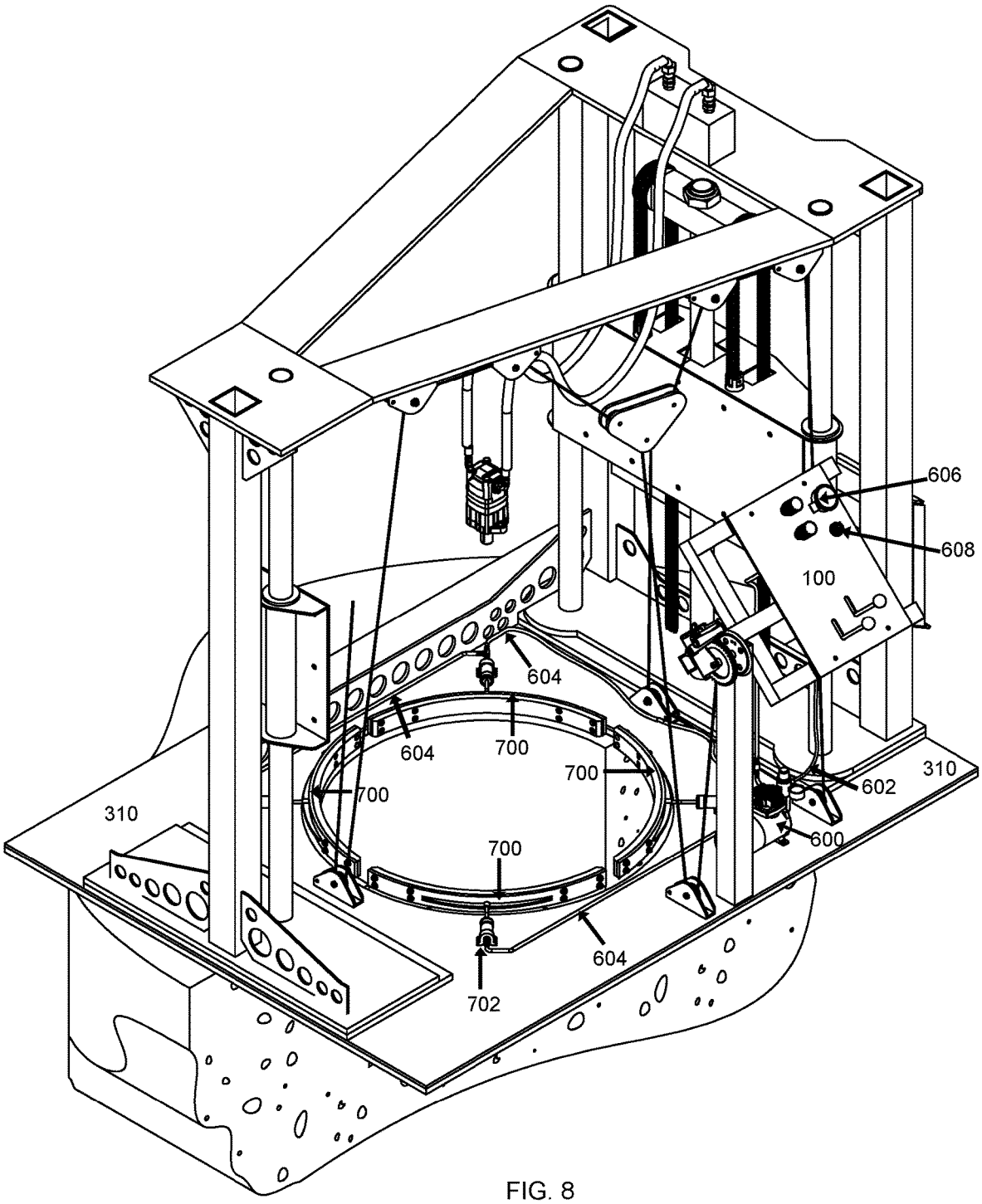
FIG. 8 depicts the device of FIG. 7 with the drum saw bit removed.

FIG. 8 depicts FIG. 7 with the drill bit removed. Each of the four drill bit stabilizers 700 is coupled to an air piston 702. Each air piston 702 receives air via hose 604 that provides air to each air piston 702. Air compressor 600 supplies air to control panel 100 via hose 602. Air pressure gauge 606 and 3-way pressure switch 608 regulate the movement of air through hose 604.

Figure 9:
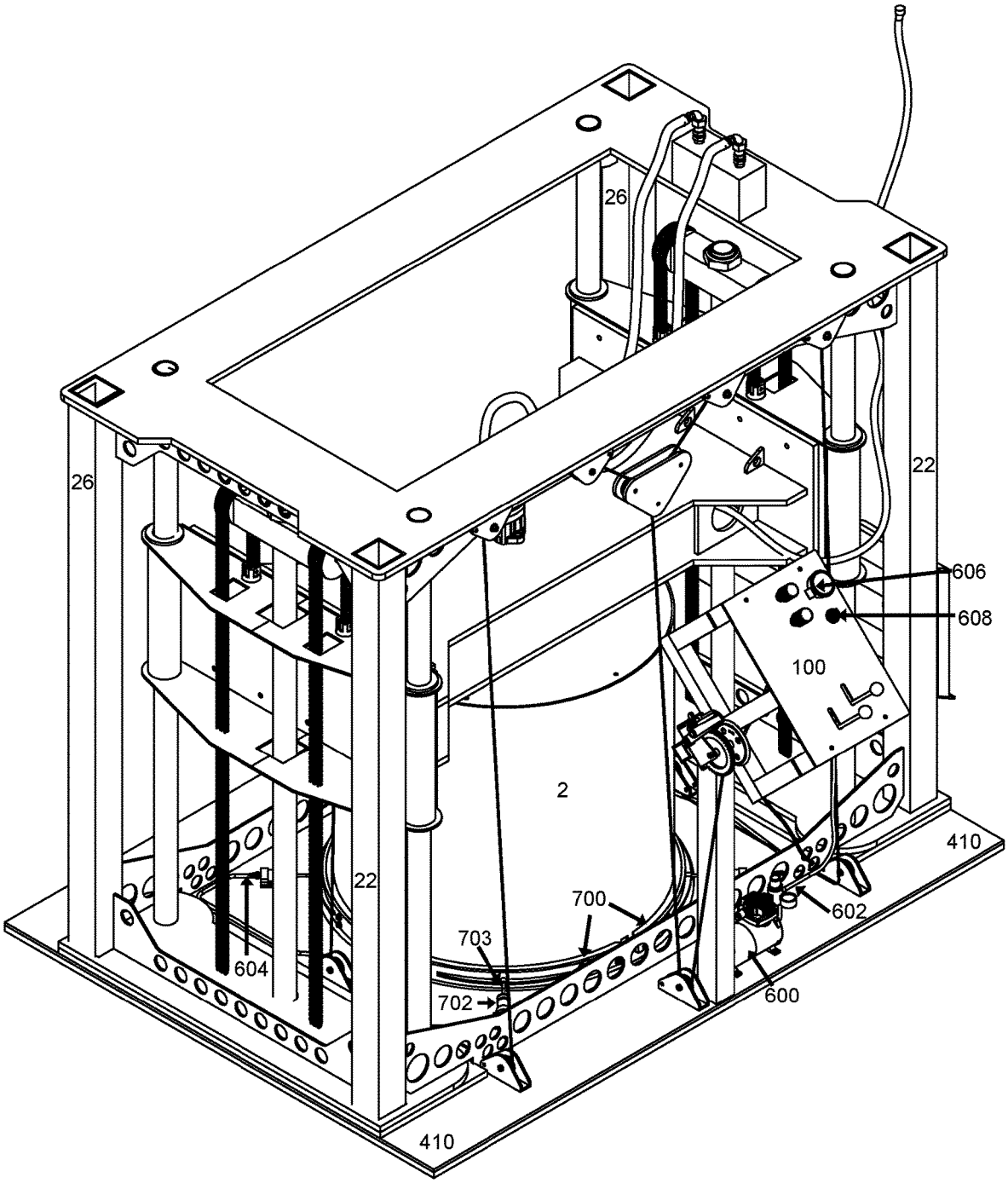
FIG. 9 depicts an front, angled view of a four-post hole coring machine with the Heavy Equipment Concrete Core Drill Bit Stabilizer attached thereto.

A user of a Heavy Equipment Concrete Core Drill Attachment with four frame posts-two frame posts 22, and two frame posts 26-is pictured in FIG. 9. Air compressor 600 is securely anchored to base 410. Air flows from air compressor 600 to control panel 100 via hose 602. Air pressure gauge 606 and 3-way pressure switch 608 regulate the movement of air through hose 604, which is secured to base 410 and supplies air to each air piston 702. Air piston guide 703 moves in and out as air is supplied to it from air piston 702. Drill bit stabilizers 700 are positioned along the circumference of drill bit 2.

Figure 10:
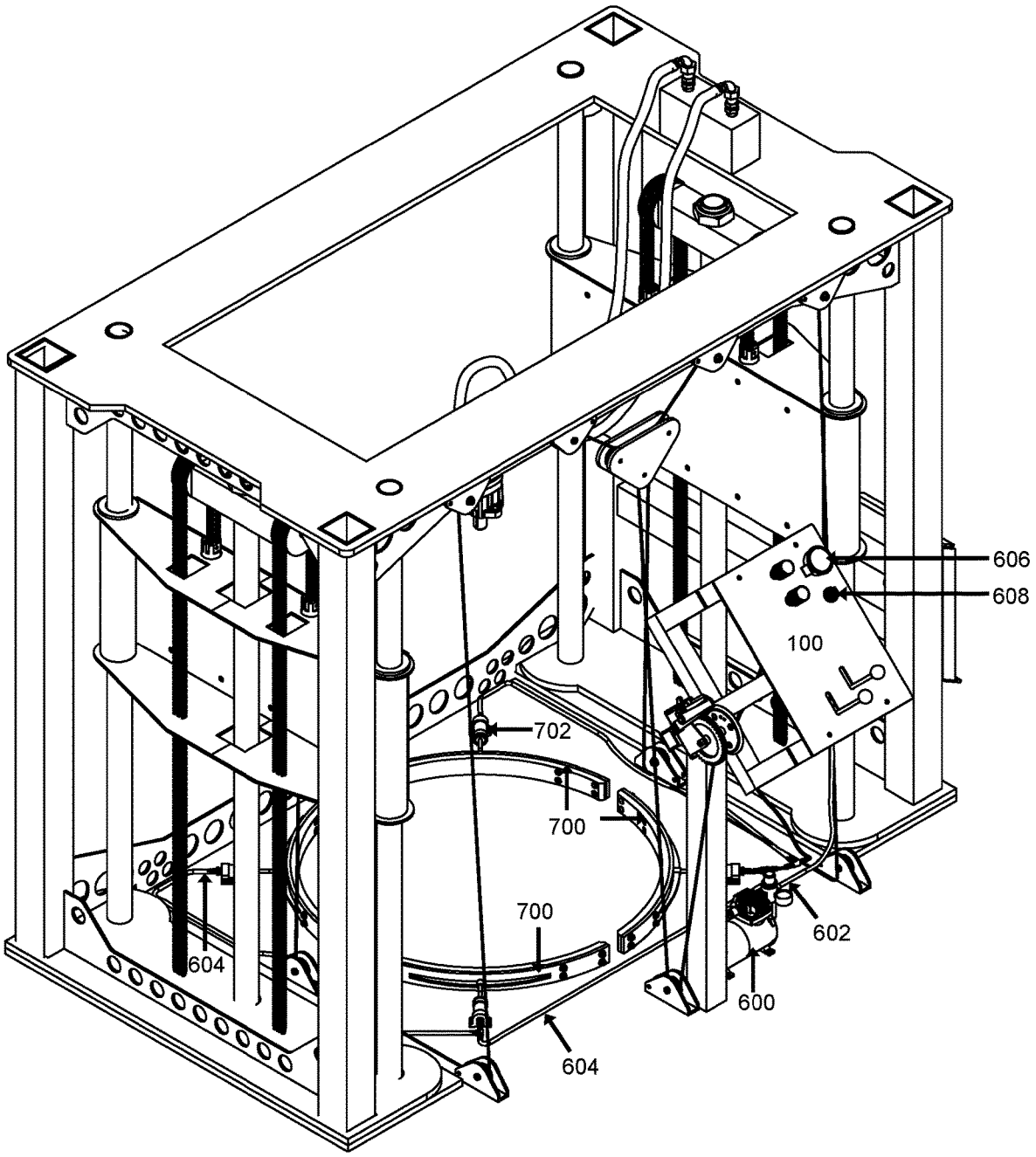
FIG. 10 depicts the device of FIG. 9 with the drum saw bit removed.
Figure 11:
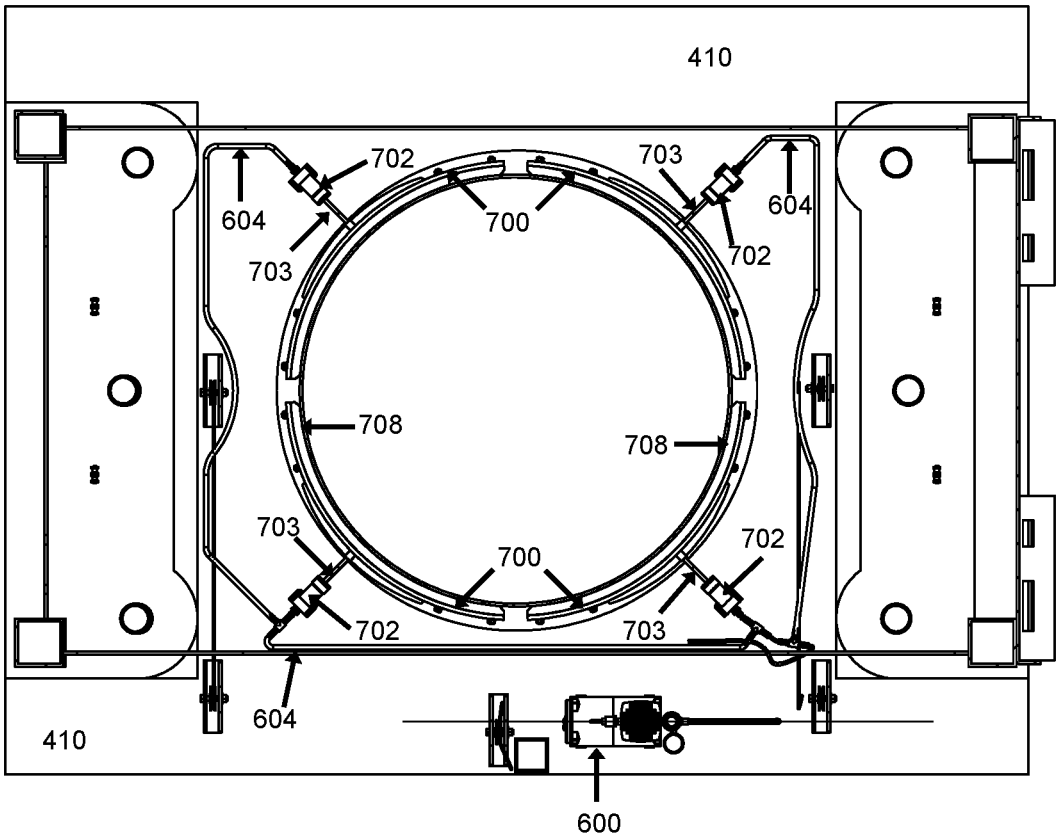
FIG. 11 depicts a top view of FIG. 9.

FIG. 10 depicts FIG. 9 with drill bit 2 and a portion of base 410 removed. Multiple drill bit stabilizers 700 are shown. The number and length of drill bit stabilizers 700 may be modified for a user's needs. Each drill bit stabilizer 700 is coupled to an air piston 702. Alternatively, multiple drill bit stabilizers 700 may be coupled to a single air piston 702. Hose 604 supplies air to each air piston 702. Air compressor 600 supplies air to control panel 100 via hose 602. Air pressure gauge 606 and 3-way pressure switch 608 regulate the movement of air from hose 602 to hose 604. A top view of FIG. 9 is depicted in FIG. 11. Four drill bit stabilizers 700 are depicted. Each drill bit stabilizer 700 is coupled to lining 708, which makes contact with drill bit 2 (not shown) and stabilizes said drill bit 2. Each drill bit stabilizer 700 is paired to a single air piston 702 via an air piston guide 703. Hose 604 supplies each air piston 702 with air to regulate the movement of air piston guide 703, and thus, the movement of drill bit stabilizer 700. Air compressor 600 is firmly secured onto base 410.

Figure 12:
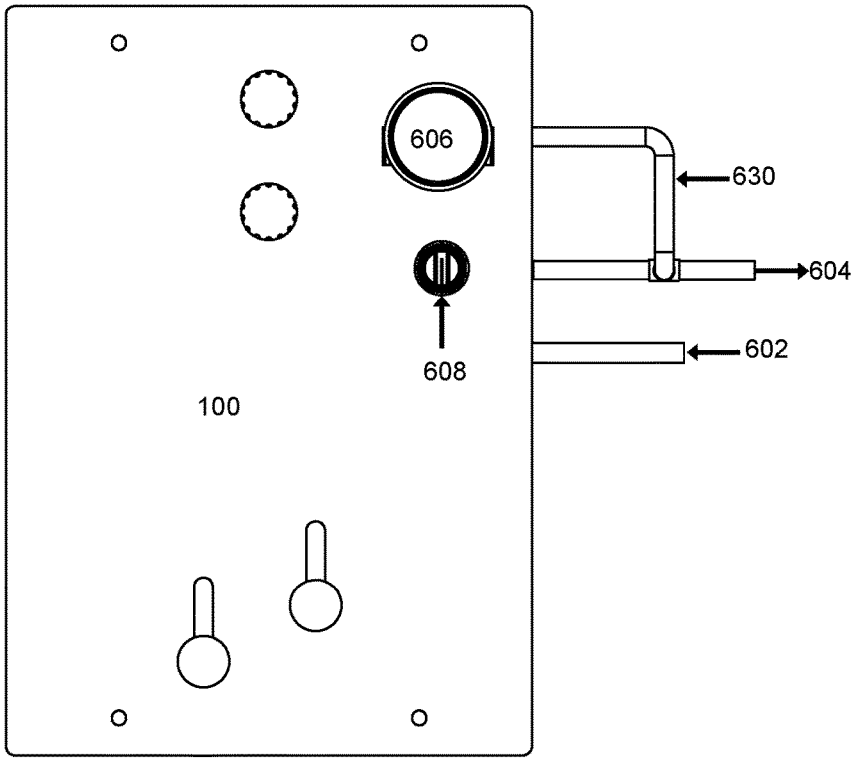
FIG. 12 depicts a front, angled view of the control panel utilized by the Heavy Equipment Concrete Core Drill Bit Stabilizer.
Figure 13:
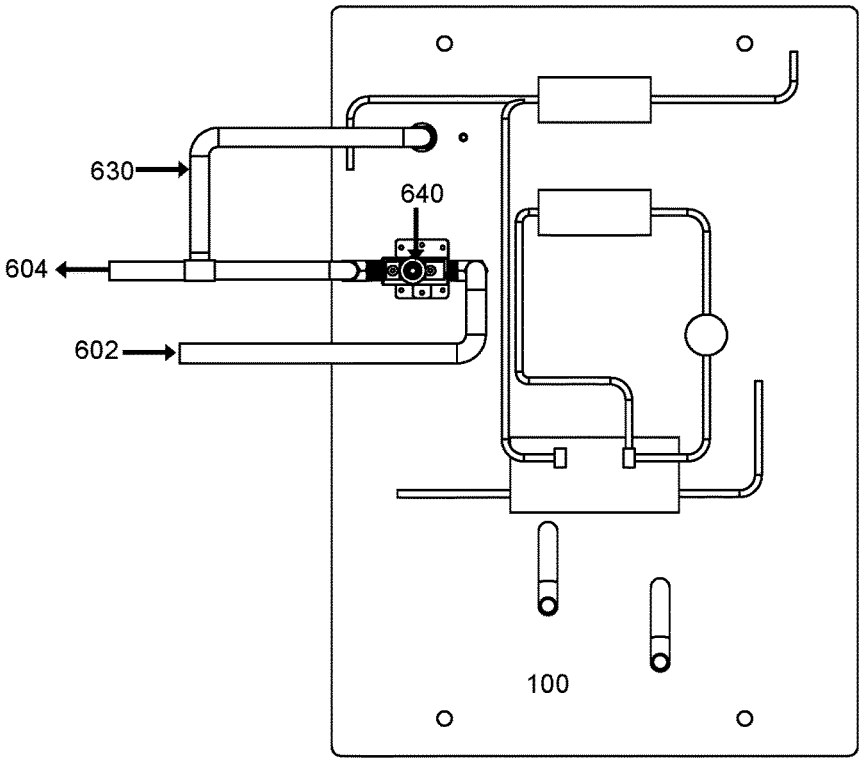
FIG. 13 depicts a back view of FIG. 12.

The front of control panel 100 is depicted in FIG. 12, while the rear view of control panel 100 is depicted in FIG. 13. Air produced by air compressor 600 (shown in FIG. 11) enters pressure bleed valve 640 (which is located on the rear of control panel 100) through hose 602. Pressure bleed valve 640 may be controlled by the rotation of 3-way pressure switch 608. The 3-way pressure switch 608 may be used to turn on air compressor 600 (shown in FIG. 11) to cause air compressor 600 to produce air that travels through hose 602 to the 3-way pressure switch 608. Excess air may be released by pressure bleed valve 640. Air to be supplied to air pistons 702 exits the 3-way pressure switch 608 and travels via hose 604 to each air piston 702 (shown in FIG. 11). A user controls the flow of air to hose 604 by turning 3-way pressure switch 608 to increase or decrease the flow of air transmitted to hose 604.

Air pressure gauge 606 may be any commercially-available air pressure that depicts the pressure of air in hose 604. Air pressure gauge 606 may be connected to hose 604 via air pressure gauge hose 630. A user rotates 3-way pressure switch 608 to increase or decrease the air pressure detected by air pressure gauge 606. 3-way pressure switch 608 controls the movement of air from pressure bleed valve 640 to hose 604.

When a user of the concrete hole coring attachment begins to core a hole in concrete, cement, or asphalt, a user may turn on air compressor 600 by manipulating the 3-way pressure switch 608 turning. Air from air compressor 600 travels via hose 602 to 3-way pressure switch 608. The pressure of the air is detected by air pressure gauge 606. If the pressure detected by air pressure gauge 606 is greater or less than the user wants, 3-way pressure switch 608 may be manipulated to decrease or increase the air pressure in hose 604. Air travels from hose 604 to each air piston 702. The increase in air pressure in hose 604 causes air piston guide 703 to extend, which pushes drill bit stabilizer 700 towards drill bit 2. The movement of drill bit stabilizer 700 towards drill bit 2 causes lining 708 to engage drill bit 2, producing friction between the surface of lining 708 and drill bit 2. The friction produced slows drill bit and forces it into the correct "round" position, stabilizing drill bit 2. Stabilizing drill bit 2 reduces both vibration of drill bit 2 and unwanted rotation of drill bit 2. This helps drill bit 2 to core a smoother, narrower cut, reducing operation time and man hours. This reduces premature wearing on drill bit 2 and extends the life of drill bit 2.

Once drill bit 2 has been stabilized, air pressure detected by air pressure gauge 606 is reduced via 3-way pressure switch 608, air piston 702 retracts air piston guide 703, which causes drill stabilizer bit 700 to move away from drill bit 2. Lining 708 is moved away from drill bit 2 allowing drill bit 2 to move freely while coring a hole in asphalt or cement.

Drill bit stabilizer 700 may be utilized to guide and stabilize drill bit 2 during the first inch or so of depth cored to establish a round, shallow groove for further drill bit 2 coring. Once the initial depth of hole is cored, a user may manipulate 3-way pressure switch 608 to bleed air from hose 604, which retracts drill bit stabilizer 700 towards air piston 702 via retraction of air piston guide 703. Following full retraction of drill bit stabilizer 700, a user may chose to manipulate 3-way pressure switch 608 turning air compressor 600 off during the remainder of coring the hole.

I hereby claim:

1. An assembly that stabilizes a round drill bit while a round drill bit is coring a hole in asphalt or cement comprising:

at least one frame member, wherein the frame member is formed in the shape of an arc, wherein the round drill bit nests within the frame member, wherein an interior diameter of the frame member is lined with a low-friction polymer, wherein the low-friction polymer acts as a brake upon the round drill bit;

at least one air piston, wherein the air piston is coupled to the frame member via a guide, wherein the guide reversibly advances the frame member towards the round drill bit and reversibly retracts the frame member away from the round drill bit; and at least one air compressor coupled to the air piston, wherein the air compressor transmits air to the air piston via at least one segment of hose.

2. The device of claim 1 wherein the assembly includes two or more frame members.

3. The device of claim 2 wherein each frame member is coupled to a single air piston.

4. The device of claim 1 further comprising a 3-way pressure switch, wherein the 3-way pressure switch regulates the transmission of air from the air compressor.

5. The device of claim 4 further comprising a pressure gauge that gauges the pressure of air within the hose.

6. The device of claim 5 further comprising a pressure bleed valve coupled to the 3-way pressure switch, wherein the pressure bleed valve may be manipulated by a user to cause the release of air from the hose.

7. The device of claim 6 further comprising a control panel, wherein the 2-way pressure switch and the pressure gauge are mounted onto the control panel.

8. A method of stabilizing a round drill bit while the round drill bit is coring a hole in asphalt or concrete comprising the step of:

applying a low-friction polymer layer of a frame member to an outer surface of the round drill bit, wherein the frame member is formed so that the round drill nests within the frame member, wherein the low-friction polymer layer engages the outer surface of the round drill bit slowing rotation of the round drill bit.

* * * * *